United States Patent [19]

Masumoto et al.

[11] Patent Number: 5,032,196

[45] Date of Patent: Jul. 16, 1991

[54] AMORPHOUS ALLOYS HAVING SUPERIOR PROCESSABILITY

[75] Inventors: Tsuyoshi Masumoto, 3-8-22, Kamisugi, Aoba-ku, Sendai-shi, Miyagi; Akihisa Inoue, Sendai; Hitoshi Yamaguchi, Okaya; Kazuhiko Kita, Sendai, all of Japan

[73] Assignees: Tsuyoshi Masumoto, Miyagi; Teikoku Piston Ring Co., Ltd.; Yoshida Kogyo K.K., both of Tokyo, all of Japan

[21] Appl. No.: 609,387

[22] Filed: Nov. 5, 1990

[30] Foreign Application Priority Data

Nov. 17, 1989 [JP] Japan ..... 1-297494

[51] Int. Cl.[5] ..... C22C 16/00

[52] U.S. Cl. ..... 148/403; 420/422

[58] Field of Search ..... 148/403, 421; 420/422, 420/423

[56] References Cited

U.S. PATENT DOCUMENTS

| | | | |
|---|---|---|---|
| 4,113,478 | 9/1978 | Tanner et al. | 148/403 |
| 4,135,924 | 1/1979 | Tanner et al. | 148/403 |
| 4,668,310 | 5/1987 | Kudo et al. | 148/403 |
| 4,854,980 | 8/1989 | Raman et al. | 148/403 |

*Primary Examiner*—R. Dean
*Assistant Examiner*—George Wyszomierski
*Attorney, Agent, or Firm*—Flynn, Thiel, Boutell & Tanis

[57] ABSTRACT

Disclosed is an amorphous alloy having superior processability which has a composition represented by the general formula:

$$X_aM_bAl_c$$

wherein

X is at least one element of Zr and Hf;

M is at least one element selected from the group consisting of Ni, Cu, Fe, Co and Mn; and a, b and c are, in atomic percentages:

$25 \leqq a \leqq 85$, $5 \leqq b \leqq 70$ and $0 < c \leqq 35$, preferably $35 \leqq a \leqq 75$, $15 \leqq b \leqq 55$ and $5 \leqq c \leqq 20$ and more preferably $55 \leqq a \leqq 70$, $15 \leqq b \leqq 35$ and $5 \leqq c \leqq 20$, the alloy being at least 50% (by volume) composed of an amorphous phase. Since the amorphous alloy is at least 50% by volume amorphous and can be present in a supercooled liquid state in a wide temperature range, it has a greatly superior processability together with high levels of strength, thermal resistance and corrosion resistance characteristic of amorphous alloys.

3 Claims, 11 Drawing Sheets

AMORPHOUS ALLOYS HAVING SUPERIOR PROCESSABILITY

BACKGROUND OF THE INVENTION

1. Field of the Invention

The present invention relates to amorphous alloys having a superior processability together with high hardness, high strength and high corrosion resistance.

2. Description of the Prior Art

Heretofore, many difficulties have been encountered in processing or working of amorphous alloys by extrusion, rolling, forging, hot-pressing or other similar operations. Generally, in amorphous alloys, a temperature range of from a glass transition temperature (Tg) to a crystallization temperature (Tx) is termed the "supercooled liquid range" and, in this temperature range, an amorphous phase is stably present and the above processing operations can be easily practiced. Therefore, amorphous alloys having a wide supercooled liquid range have been desired. However, most known amorphous alloys do not have such a temperature range or, if they do, they have a very narrow supercooled liquid range. Among known amorphous alloys, certain noble metal alloys, typically $Pd_{48}Ni_{32}P_{20}$, possess a relatively broad supercooled liquid range of the order of 40 degrees K., and can be subjected to the processing operations. However, in even these alloys, very strict restrictions have been imposed on the processing conditions. In addition, the noble metal alloys are practically disadvantageous with respect to their material cost because they contain an expensive noble metal as a main component.

In view of the situation, the present Inventors have many detailed studies to obtain amorphous alloys which have a wide supercooled liquid range and, in this range, can be subjected to the foregoing processing operations, at a low cost. As a result, the Inventors have proposed alloys having a wide supercooled liquid range in Inventors' previous U.S. Patent Application Ser. No. 542 747 filed June 22, 1990. However, in order to further relax the restrictions on the processing conditions and thereby make the practical applications thereof easier, alloys having a further broadened supercooled liquid range have been further desired.

SUMMARY OF THE INVENTION

It is accordingly, an object of the present invention to provide novel amorphous alloys which can be in a supercooled liquid state in a wide temperature range and, thereby, have excellent processability combined with high levels of hardness, strength, thermal resistance and corrosion resistance and made, at a low cost.

According to the present invention, there is provided an amorphous alloy having superior in processability which has a composition represented by the general formula:

$$X_aM_bAl_c$$

wherein:

X is at least one or two elements of Zr and Hf;

M is at least one element selected from the group consisting of Ni, Cu, Fe, Co and Mn; and a, b and c are, in atomic percentages:

$25 \leqq a \leqq 85$, $5 \leqq b \leqq 70$ and $0 < c \leqq 35$, the alloy being at least 50% (by volume) composed of an amorphous phase.

Particularly, in order to ensure a wider supercooled liquid range, "a", "b" and "c" in the above general formula are, in atomic %, preferably $35 \leqq a \leqq 75$, $15 \leqq b \leqq 55$ and $5 \leqq c \leqq 20$ and more preferably $55 \leqq a \leqq 70$, $15 \leqq b \leqq 35$ and $5 \leqq c \leqq 20$.

According to the present invention, there can be obtained an amorphous alloy having an advantageous combination of properties of high hardness, high strength, high thermal resistance and high corrosion resistance, which are characteristic of an amorphous alloy, since the amorphous alloy is a composite having at least 50% by volume an amorphous phase. In addition, the present invention provides an amorphous alloy having superior processability at a relatively low cost, since the amorphous alloy has a wide supercooled liquid temperature range and a good elongation of at least 1.6%.

DETAILED DESCRIPTION OF THE PREFERRED EMBODIMENTS

Figure 1:
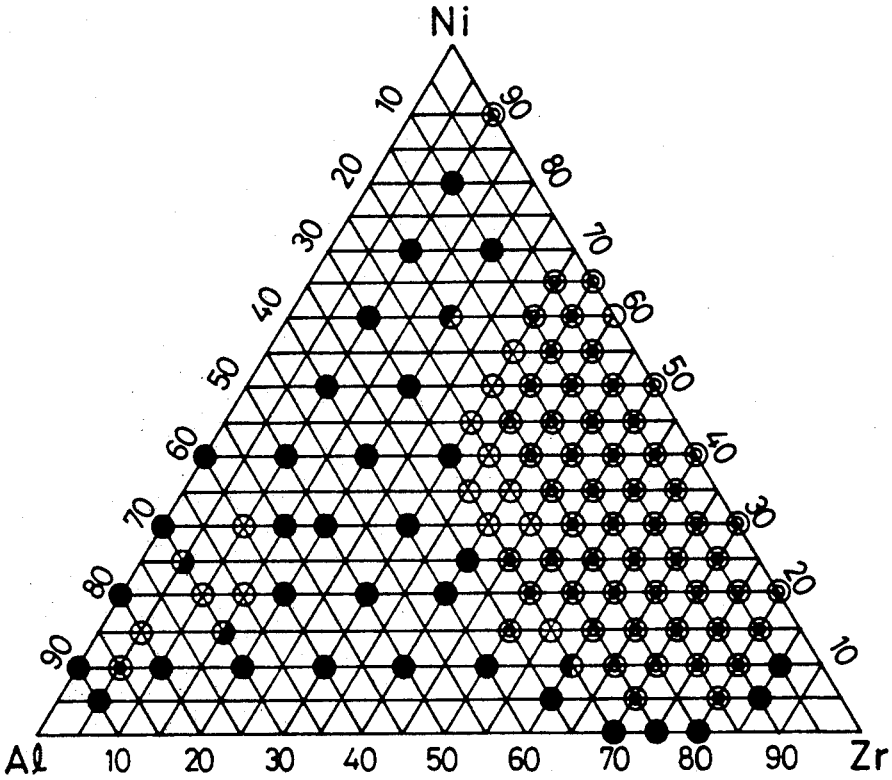
FIG. 1 is a compositional diagram of Zr-Ni-Al system alloys of examples of the present invention.

The amorphous alloys of the present invention can be obtained by rapidly solidifying a melt of the alloy having the composition as specified above by means of a liquid quenching technique. The liquid quenching technique is a method for rapidly cooling a molten alloy and, particularly, single-roller melt-spinning technique, twin roller melt-spinning technique, in-rotating-water melt-spinning technique or the like are mentioned as effective examples of such techniques. In these techniques, a cooling rate of about $10^4$ to $10^6$K/sec can be obtained. In order to produce thin ribbon materials by the single-roller melt-spinning technique, twin roller melt-spinning technique or the like, the molten alloy is ejected from the opening of a nozzle onto a roll made of, for example, copper or steel, with a diameter of 30–3000 mm, which is rotating at a constant rate within the range of 300–10000 rpm. In these techniques, various thin ribbon materials with a width of about 1–300 mm and a thickness of about 5–500 μm can be readily obtained. Alternatively, in order to produce fine wire materials by the in-rotating-water melt-spinning technique, a jet of the molten alloy is directed, under application of a back pressure of argon gas, through a nozzle into a liquid refrigerant layer having a depth of about 10 to 100 mm and retained by centrifugal force in a drum rotating at a rate of about 50 to 500 rpm. In such a manner, fine wire materials can be readily obtained. In this technique, the angle between the molten alloy ejecting from the nozzle and the liquid refrigerant surface is preferably in the range of about 60° to 90° and the ratio of the velocity of the ejected molten alloy to the velocity of the liquid refrigerant face is preferably in the range of about 0.7 to 0.9.

Besides the above process, the alloy of the present invention can be also obtained in the form of a thin film by a sputtering process. Further, a rapidly solidified powder of the alloy composition of the present invention can be obtained by various atomizing processes, for example, a high pressure gas atomizing process, or a spray process.

Whether the rapidly solidified alloys thus obtained are amorphous or not can be known by checking the presence of the characteristic halo pattern of an amorphous structure using an ordinary X-ray diffraction method. The amorphous structure is transformed into a crystalline structure by heating to or above a certain temperature (called "crystallization temperature").

In the amorphous alloys of the present invention represented by the above general formula, "a", "b" and "c" are limited to atomic percentages ranging from 25 to 85%, 5 to 70% and more than 0 (not including 0) to 35%, respectively. The reason for such limitations is that when "a", "b" and "c" stray from the above specified ranges and certain ranges, it is difficult to form an amorphous, phase in the resulting alloys and the intended alloys, at least 50 volume % of which is composed of an amorphous phase, can not be obtained by industrial cooling techniques using the above-mentioned liquid quenching techniques, etc. In the above-specified compositional range, the alloys of the present invention exhibit the advantageous properties, such as high hardness, high strength and high corrosion resistance which are characteristic of amorphous alloys. The certain ranges set forth above are those disclosed in Assignee's prior patent applications, i.e., Japanese Patent Application Laid-Open Nos. 64- 47 831 and 1 - 275 732, and compositions known up to now. These ranges are excluded from the scope of the claims of the present invention in order to avoid any compositional overlap.

Due to the above specified compositional range, the alloys of the present invention, besides the above-mentioned various superior advantages inherent to amorphous alloys, can be bond-bended to 180° in a thin ribbon form. In addition, the amorphous alloys exhibit a superior ductility sufficient to permit an elongation of at least 1.6% and are useful in improving material properties such as impact resistance, elongation etc. Further, the alloys of the present invention exhibit a very wide supercooled liquid temperature range, i.e., Tx-Tg, and, in this range, the alloy is in a supercooled liquid state. Therefore, the alloy can be successfully subjected to a high degree of deformation under a low stress and exhibits a very good degree of processability. Such advantageous properties make the alloys useful as materials for component having complicated shapes and materials subjected to processing operations requiring a high degree of plastic flowability.

The "M" element is at least one element selected from the group consisting of Ni, Cu, Fe, Co and Mn. When these elements exist with Zr and/or Hf, they not only improve the alloys ability to form an amorphous phase, but also provide an increased crystallization temperature together with improved hardness and strength.

Al in existence with the "X" and "M" elements provides a stable amorphous phase and improves the alloy's ductility. Further, Al broadens the supercooled liquid region, thereby providing improved processability.

The alloys of the present invention exhibit a supercooled liquid state (supercooled liquid range) in a very wide temperature range and, in some alloy compositions, the temperature ranges are 50 degrees K or more. Particularly, when "a", "b" and "c" in the above general formula are, in atomic %, $35 \leqq a \leqq 75$, $15 \leqq b \leqq 55$ and $5 \leqq c \leqq 20$, the resultant alloys can be present in a supercooled liquid state in a temperature range of at least 40 degrees K. Further, when "a", "b" and "c" are, in atomic percentages, $55 \leqq a \leqq 70$, $15 \leqq b \leqq 35$ and $5 \leqq c \leqq 20$, a further broader supercooled liquid temperature range of at least 60 degrees K can be ensured. In the temperature range of the supercooled liquid state, the alloys can be easily and freely deformed under low pressure and restrictions on the processing temperature and time can be relaxed. Therefore, a thin ribbon or powder of the alloy can be readily consolidated by conventional processing techniques, such as extrusion, rolling, forging or hot pressing. Further, due to the same reason, when the alloy of the present invention is mixed with other powder, they easily consolidated into a composite material at a lower temperature and a lower pressure. Further, the amorphous alloy thin ribbon of the present invention produced through a liquid quenching process can be bond-bended to 180° in a broad compositional range without occurring cracks or separation from a substrate. The amorphous alloy exhibits an elongation of at least 1.6% and a good ductility at room temperature. Further, since the alloy composition of the present invention easily provides an amorphous phase alloY, the amorphous alloy can be obtained by water quenching.

Also, when the alloy of the present invention contains, besides the above specified elements, other elements, such as Ti, C, B, Ge, Bi, etc. in a total amount of not greater than 5 atomic %, the same effects as described above can be obtained.

Now, the present invention will be more specifically described with reference to the following examples.

EXAMPLE 1

Figure 19:
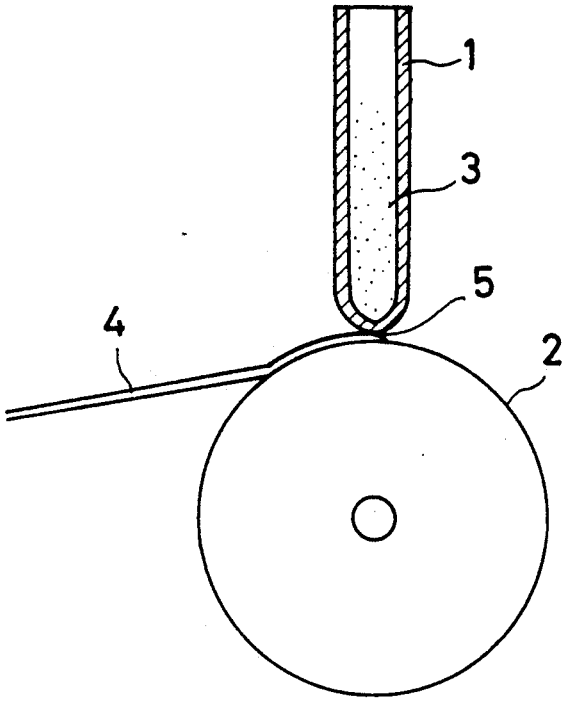
FIG. 19 is an illustration showing an example of the preparation of the invention alloy.

Molten alloy 3 having a predetermined composition was prepared using a high-frequency induction melting furnace and was charged into a quartz tube 1 having a small opening 5 with a diameter of 0.5 mm at the tip thereof, as shown in FIG. 19. After heating to melt the alloy 3, the quartz tube 1 was disposed above a copper roll 2 with a diameter of 200 mm. Then, the molten alloy 3 contained in the quartz tube 1 was ejected from the small opening 5 of the quartz tube 1 by application of an argon gas pressure of 0.7 kg/cm$^2$ and brought into contact with the surface of the roll 2 rapidly rotating at a rate of 5,000 rpm. The molten alloy 3 was rapidly solidified and an alloy thin ribbon 4 was obtained.

Figure 20:
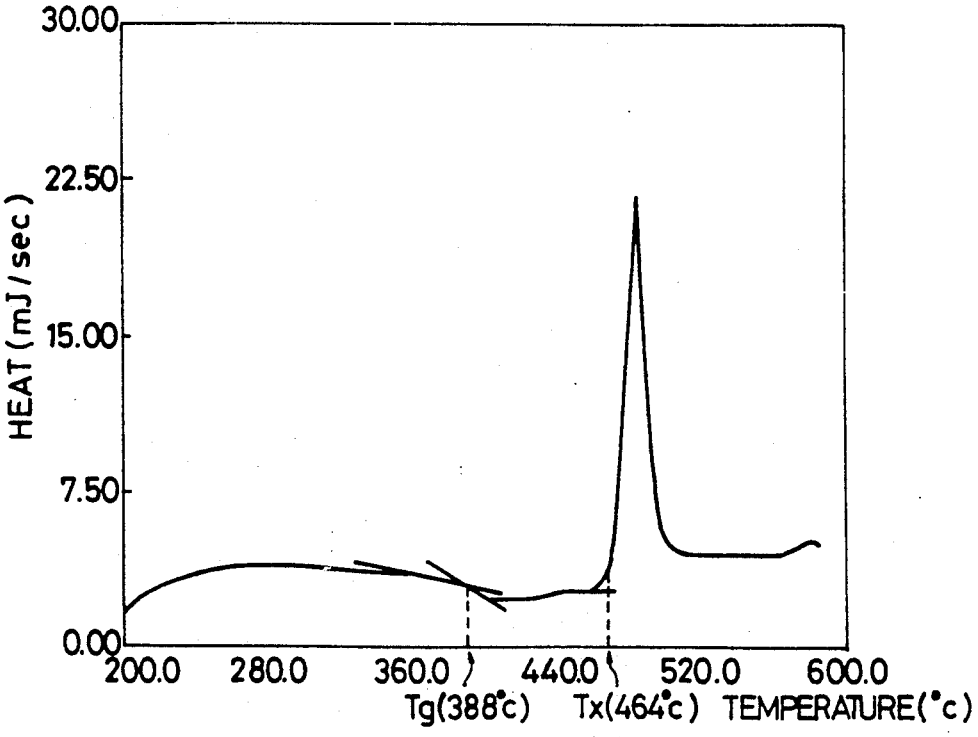
FIG. 20 is a schematic diagram showing how to measure Tg and Tx.

The way to determine Tg (glass transition temperature) and Tx (crystallization temperature) in the present invention will now be explained, taking the differential scanning calorimetric curve of the $Zr_{65}Cu_{27.5}Al_{7.5}$ alloy shown in FIG. 20 by way of example. On the curve, Tg (glass transition temperature) is the intersection point on the base line obtained by extrapolating from the starting point of an endothermic reaction to the base line and, in this example, the intersection point is 388 ° C. Similarly, Tx (crystallization temperature) was obtained from the starting point of an exothermic reaction. The Tx of $Zr_{65}Cu_{27.5}Al_{7.5}$ alloy was 464 ° C.

According to the processing conditions as described above, there were obtained thin ribbons of ternary alloys, as shown in a compositional diagram of a Zr-Ni-Al system (FIG. 1). In the compositional diagram, the percentages of each element are lined with a interval of 5 atomic %. X-ray diffraction analysis for each thin ribbon showed that an amorphous phase was obtained in a very wide compositional range. In FIG. 1, the mark " " indicates an amorphous phase and a ductility sufficient to permit bond-bending of 180° without fracture, the mark " " indicates an amorphous phase and brittleness, the mark " " indicates a mixed phase of a crystalline phase and an amorphous phase, and the mark " " indicates a crystalline phase.

FIGS. 2, 3, 4 and 5 show the measurement results of the hardness (Hv), glass transition temperature (Tg), crystallization temperature (Tx) and supercooled liquid range (Tx-Tg), respectively, for each thin ribbon specimen.

Figure 6:
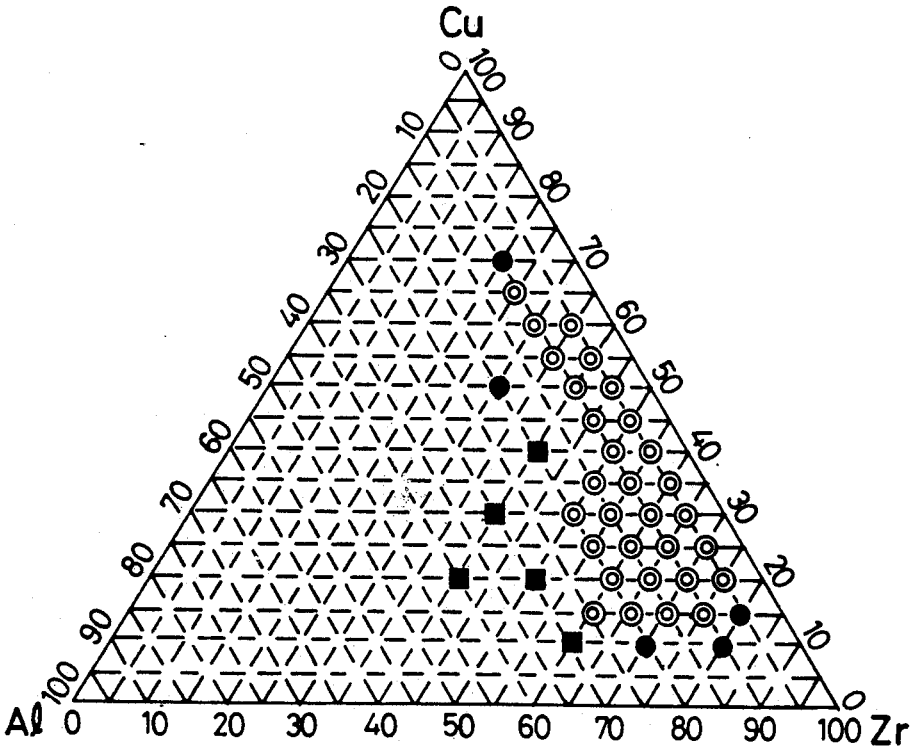
FIG. 6 is a compositional diagram of Zr-Cu-Al system alloys.
Figure 11:
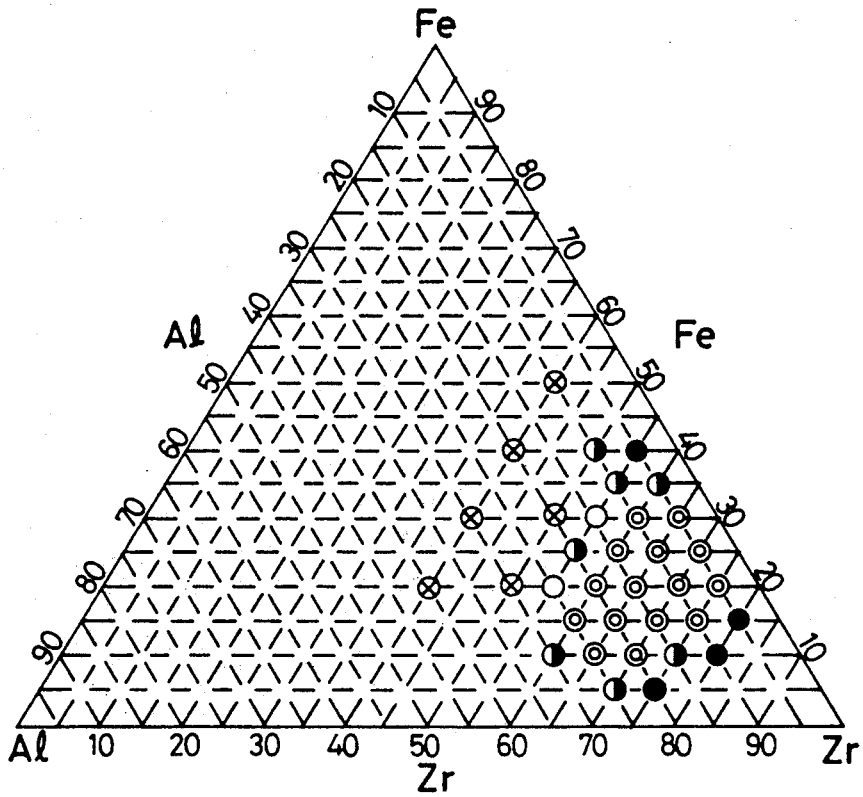
FIG. 11 is a compositional diagram of Zr-Fe-Al system alloys.
Figure 15:
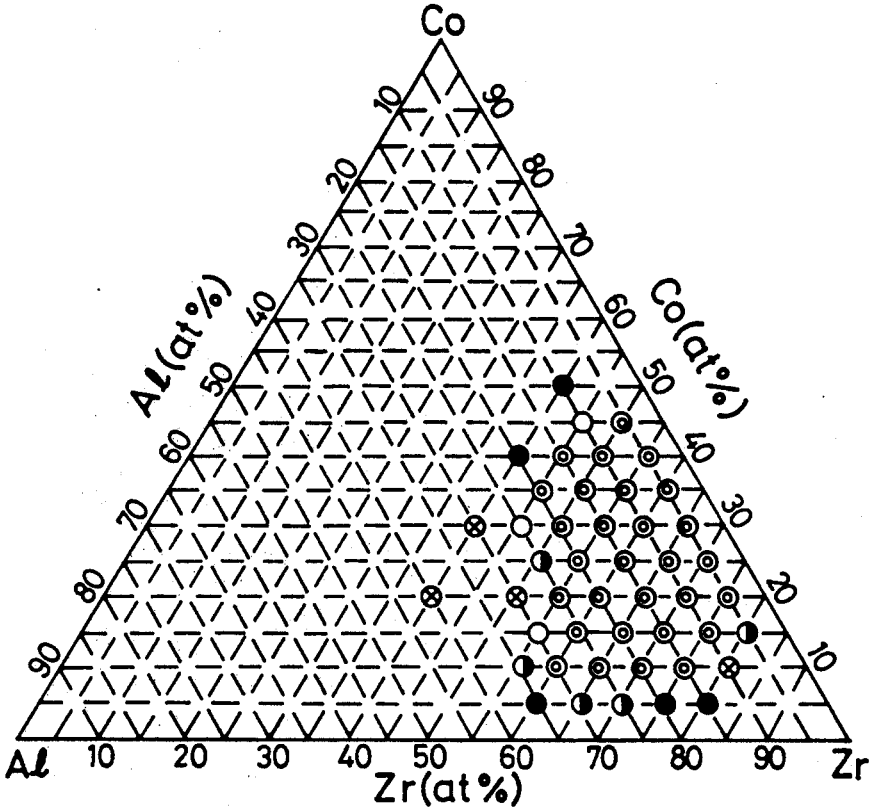
FIG. 15 is a compositional diagram of Zr-Co-Al system alloys.

Similarly, the compositional diagrams of Zr-Cu-Al system, Zr-Fe-Al system and Zr-Co-Al system alloys are show in FIGS. 6, 11 and 15, respectively. The mark " " in FIG. 6 shows compositions which can not be subjected to liquid quenching, the mark " " in FIGS. 11 and 15 shows compositions which can not be formed into thin ribbons.

Further, in a similar manner to the above, the measurement results of the hardness (Hv), glass transition temperature (Tg), crystallization temperature (Tx) and supercooled liquid range (Tx-Tg) are shown in FIGS. 7 to 10, 21, 12 to 14, 22 and 16 to 18.

Hereinafter, the above measurement results will be more specifically described.

Figure 2:
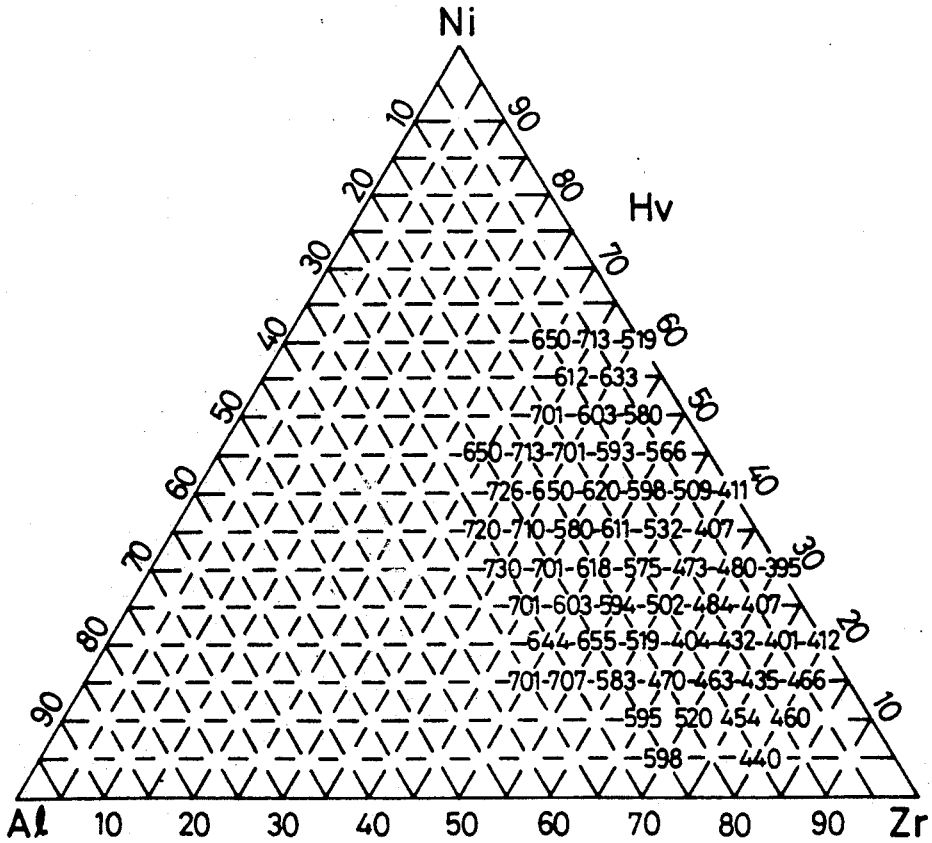
FIGS. 2, 3, 4 and 5 are diagrams showing the measurement results of hardness, glass transition temperature, crystallization temperature and supercooled liquid temperature range for the same alloys, respectively.

FIG. 2 indicates the hardness distribution of thin ribbons falling within the amorphous phase region in the Zr-Ni-Al system compositions shown in FIG. 1. The thin ribbons have a high level of hardness (Hv) of 401 to 730 (DPN) and the hardness decreases with increase in the Zr content. The hardness Hv shows a minimum value of 401 (DPN) when the Zr content is 7.5 atomic % and, thereafter, it slightly increases with an increase in the Zr content.

Figure 3:
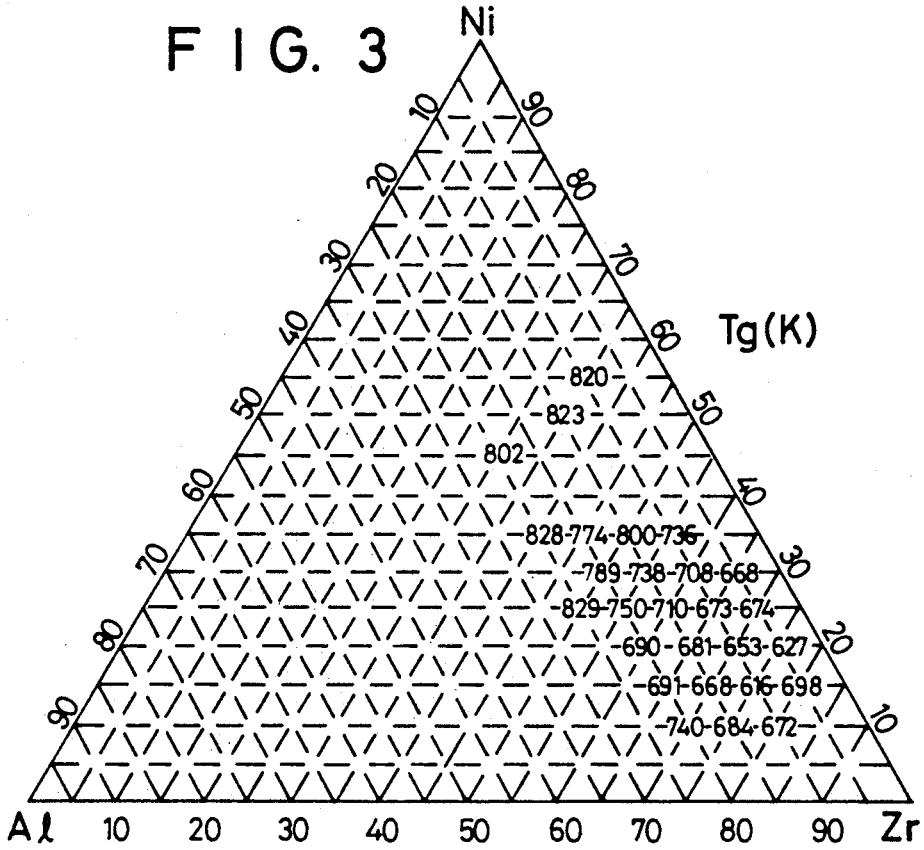

FIG. 3 shows the change in Tg (glass transition temperature) of the amorphous phase region shown in FIG. 1 and the Tg change greatly depends on the variation in the Zr content, as in the hardness change. More specifically, when the Zr content is 50 atomic %, the Tg value is 829 K and, thereafter, the Tg decreases with increase in the Zr content and reaches 616 K at a Zr content of 75 atomic %.

Figure 4:
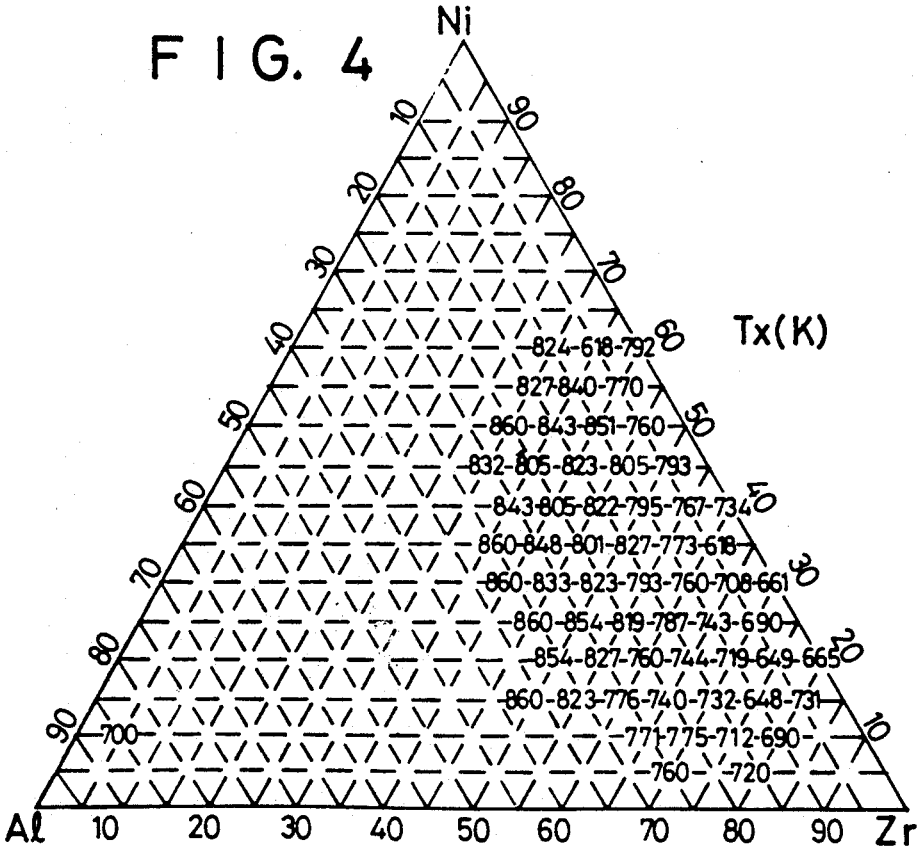

FIG. 4 illustrates the variation in Tx (crystallization temperature) of thin ribbons falling within the amorphous phase forming region shown in FIG. 1 and shows a strong dependence on the content of Zr as referred to FIGS. 2 and 3.

More specifically, a Zr content of 30 atomic % provides a high Tx level of 860 K but, thereafter, the Tx decreases with an increase in the Zr content. A Zr content of 75 atomic % provides a minimum Tx value of 648 K and, thereafter, the Tx value slightly increases.

Figure 5:
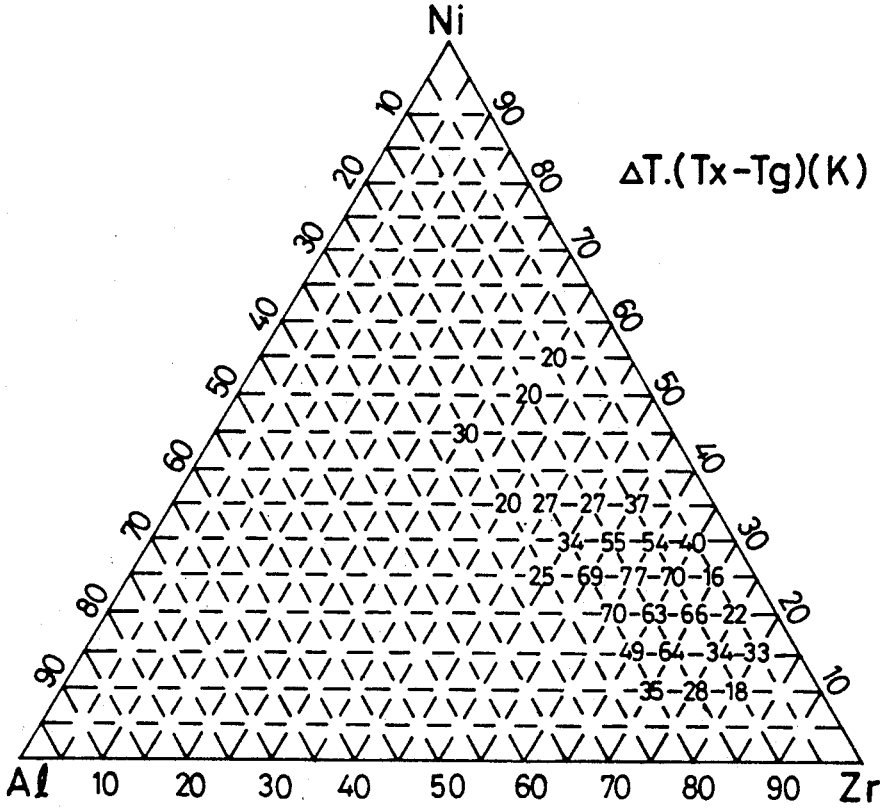

FIG. 5 is a diagram plotting the temperature difference (Tx-Tg) between Tg and Tx which are shown in FIGS. 3 and 4, respectively, and the temperature difference corresponds to the supercooled liquid temperature range. In the diagram, the wider the temperature range, the more stable the amorphous phase becomes. When carrying out forming operations in such a temperature range while maintaining an amorphous phase, the operations can be carried out in wider ranges of operation temperature and time and various operation conditions can be easily controlled. A value of 77 degrees K at a Zr content of 60 atomic % shown in FIG. 5 reveals that the resultant alloys have a stable amorphous phase and a superior processability.

Figure 7:
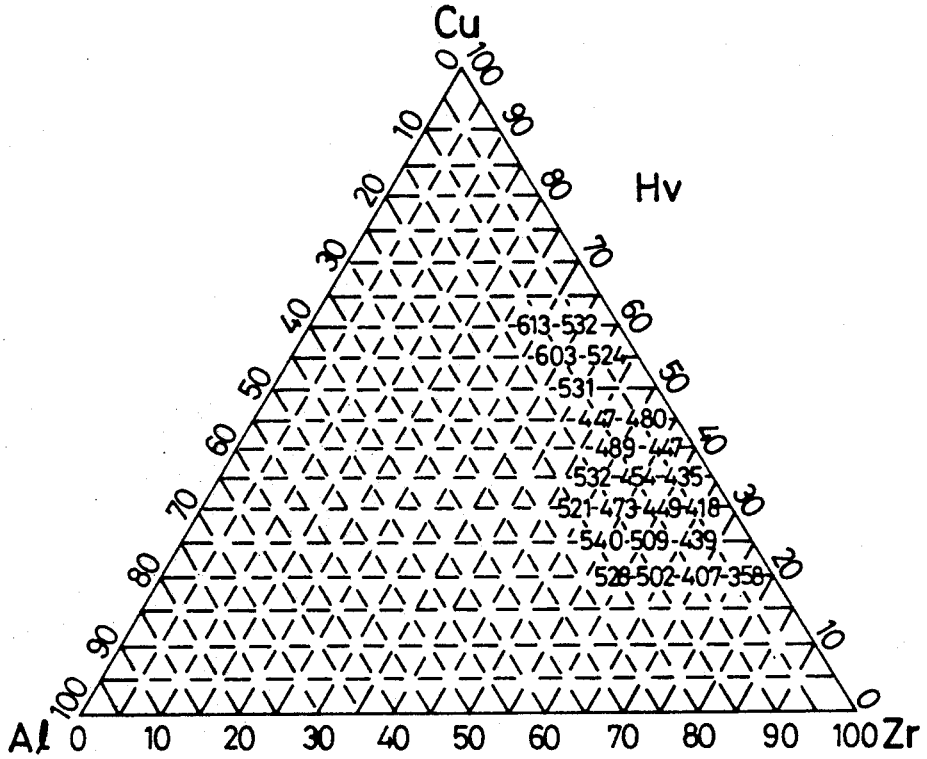
FIGS. 7, 8, 9 and 10 are diagrams showing the measurement results of hardness, glass transition temperature, crystallization temperature and supercooled liquid temperature range for the same system alloys, respectively.

Further, the Zr-Cu-Al system compositions shown in FIG. 6 were tested in the same manner as set forth above. FIG. 7 shows the hardness distribution of thin ribbons falling within the amorphous phase region in the compositions shown in FIG. 6. The hardness of the thin ribbons is on the order of 358 to 613 (DPN) and decreases with an increase in the Zr content.

Figure 8:
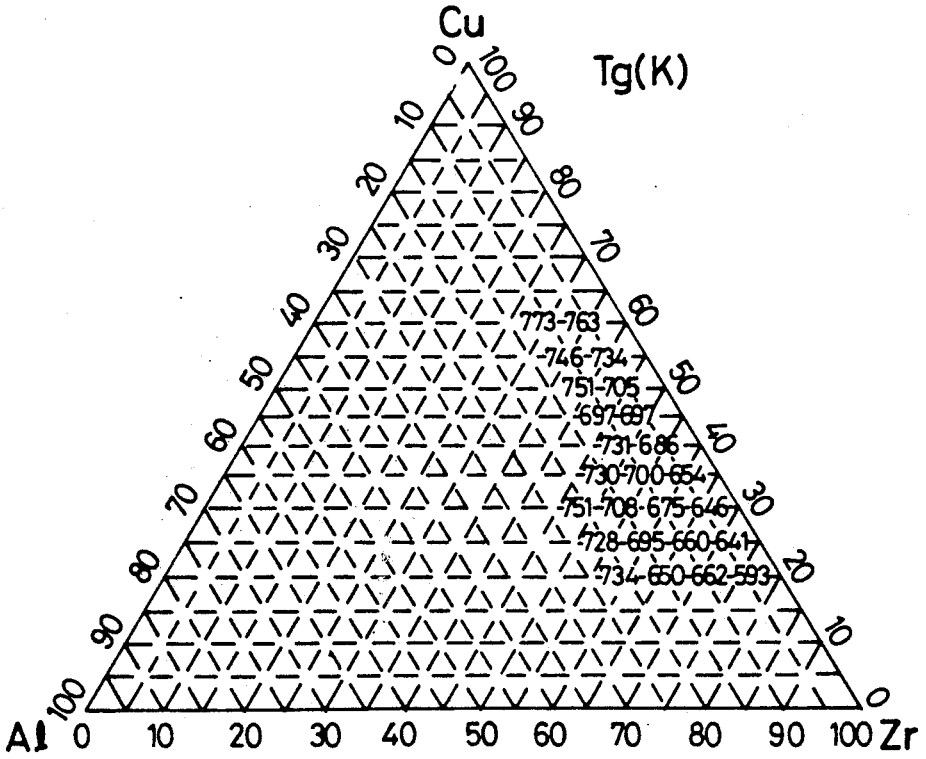
Figure 9:
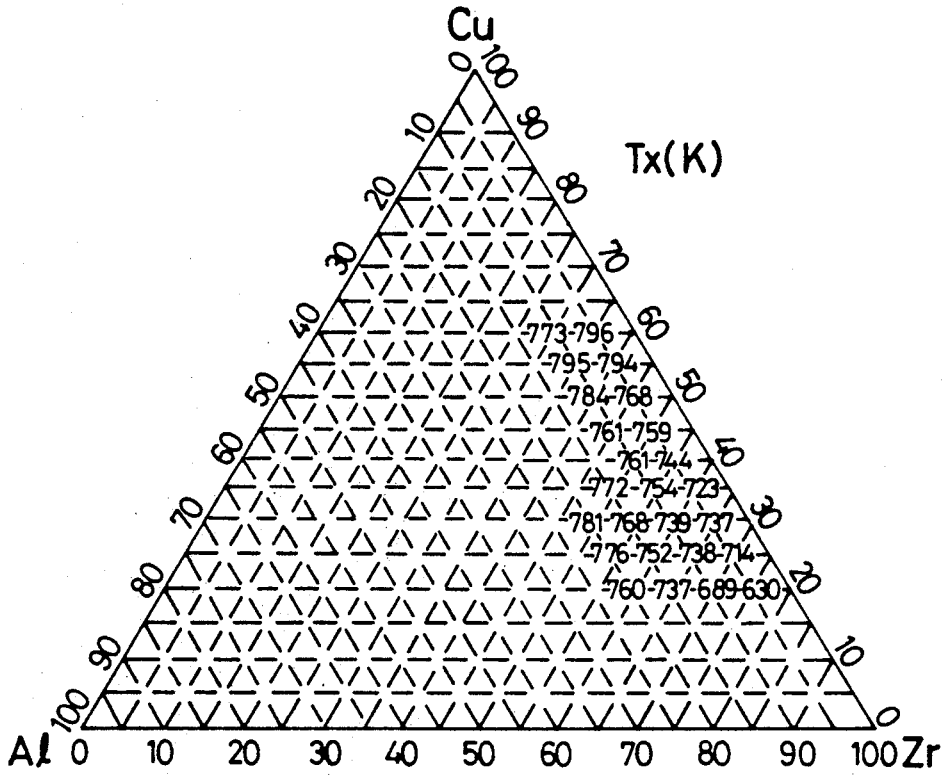
Figure 10:
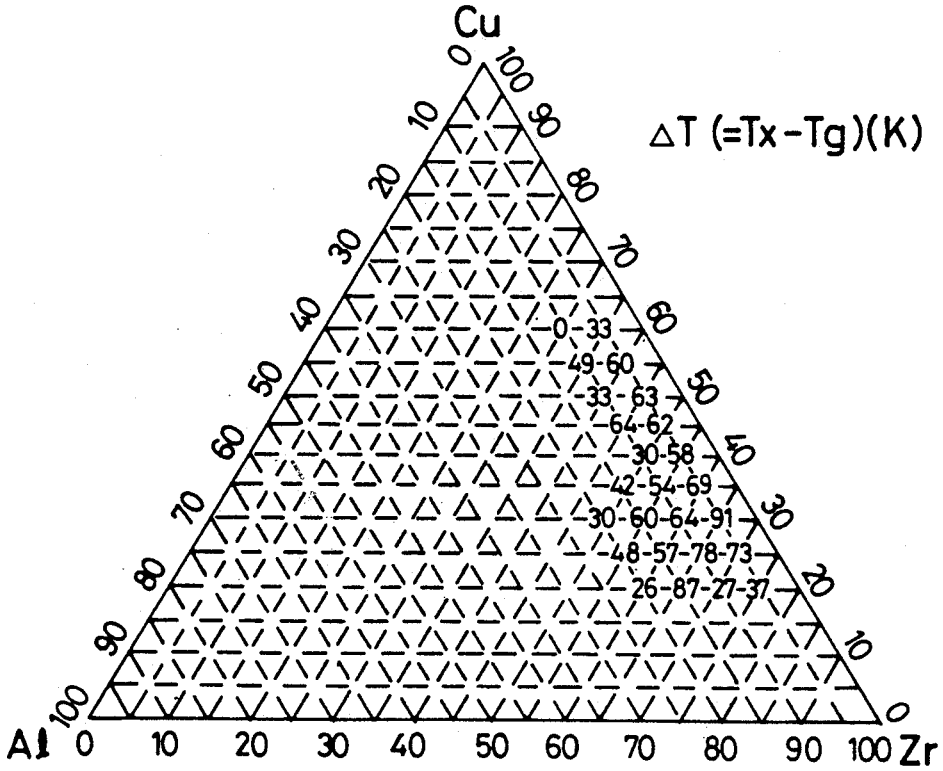

FIG. 8 shows the change of Tg (glass transition temperature) in the amorphous-phase forming region shown in FIG. 6. This change greatly depends on the variation of the Zr content, as referred to the hardness change. In detail, when the Zr content is 30 atomic %, the Tg value is 773 degrees K and, with increase in the Zr content, the Tg value decreases. When the Zr content is 75 atomic %, the Tg value decrease to 593 degrees K. FIG. 9 shows the change of Tx (crystallization temperature) in the amorphous-phase forming region shown in FIG. 6 and shows a strong dependence on the content of Zr as referred to FIGS. 7 and 8. In detail, the Tx value is 796 degrees K at 35 atomic % Zr, decreases with increases in the Zr content and reaches 630 degrees K at 75 atomic % of Zr. FIG. 10 is a diagram plotting the temperature difference between Tg and Tx (Tx-tg) shown in FIG. 8 and 9 and the temperature difference shows the supercooled liquid temperature range. In the figure, a large value of 91 degrees K is shown at a Zr content of 65 atomic %.

Figure 12:
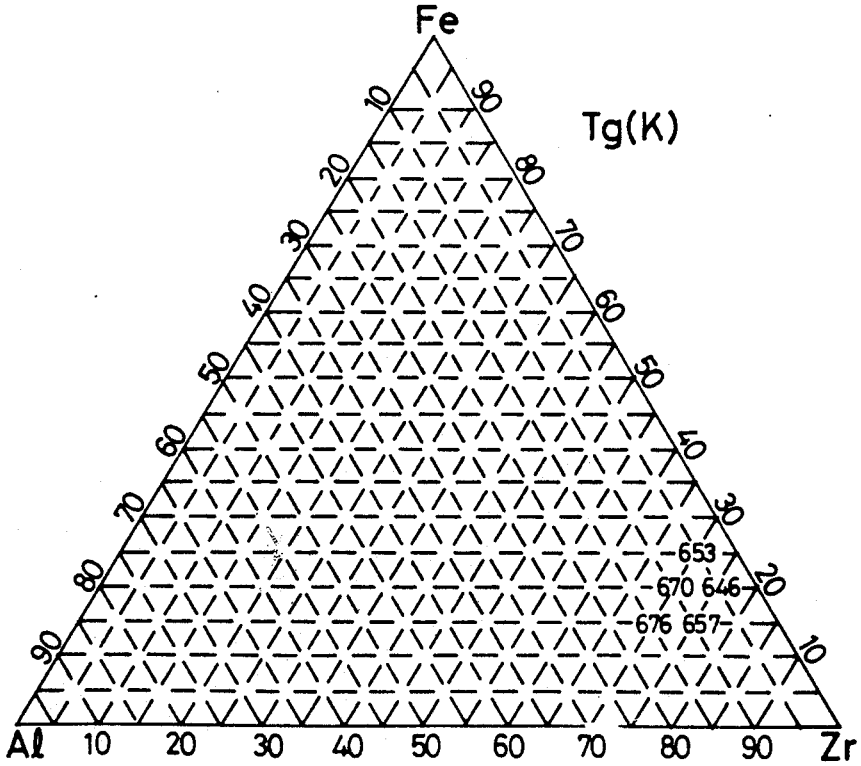
FIGS. 12, 13 and 14 are diagrams showing the measurement results of glass transition temperature, crystallization temperature and supercooled liquid temperature range for the same system alloys, respectively.
Figure 13:
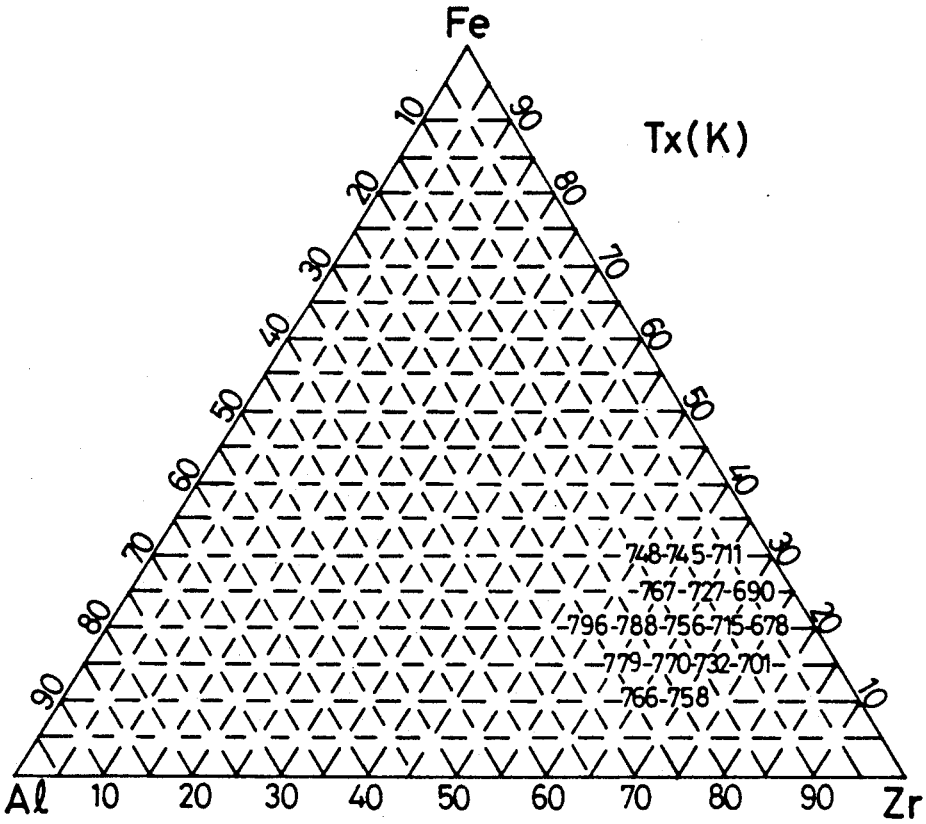
Figure 14:
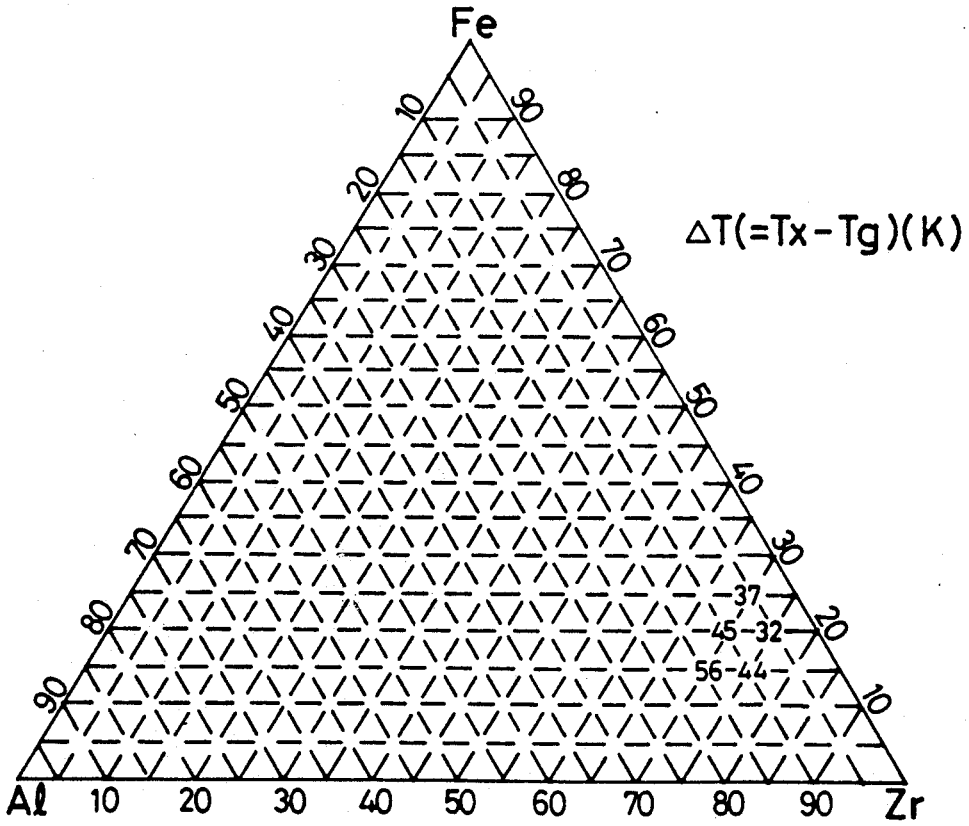
Figure 21:
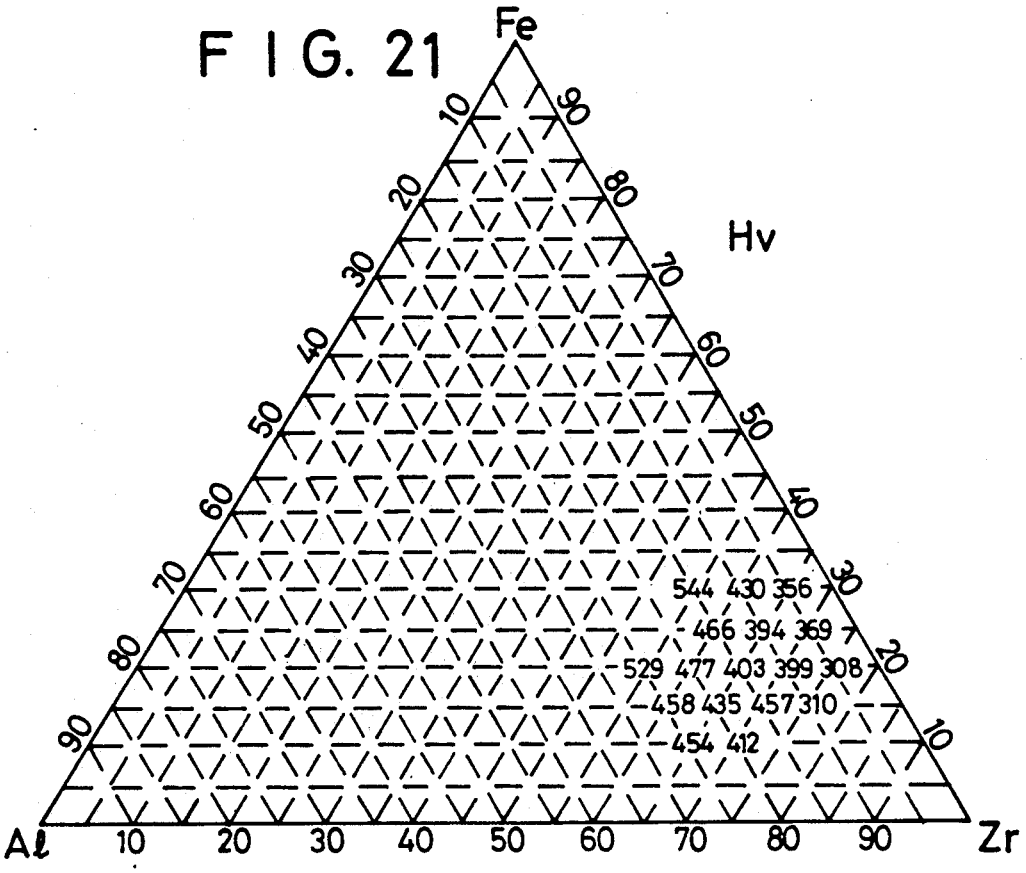
FIG. 21 is a diagram showing the measurement results of hardness for Zr-Fe-Al system alloys.

The Zr-Fe-Al system compositions shown in FIG. 11 were also tested in the same way as set forth above. FIG. 21 shows the hardness distribution of ribbons falling within the amorphous-phase region in the compositions shown in FIG. 11. The hardness (Hv) distribution of the thin ribbons ranges from 308 to 544 (DPN) and an increase in Zr content results in a reduction of the hardness. FIG. 12 shows the change of Tg (glass transition temperature) of the amorphous-phase forming region shown in FIG. 11 and the change greatly depends on the Zr content variation. In detail, the Tg value is 715 K degrees at 70 atomic % Zr, decreases with increase of the Zr content and reaches 646 degrees K at 75 atomic % Zr. FIG. 13 shows the variation of Tx (crystallization temperature) of the amorphous-phase forming region shown in FIG. 11 and reveals a strong dependence on the Zr content, as referred to FIG. 12. In detail, the Tx value is 796 K degrees at 55 atomic % Zr, then decreases with increase of the Zr content and reduces to 678 K degrees at 75 atomic % Zr. FIG. 14 shows the temperature difference (Tx-Tg) between Tg and Tx shown in FIGS. 12 and 13 and the temperature difference corresponds to the supercooled liquid temperature range. The figure shows a temperature difference of 56 K degrees at 70 atomic % Zr.

Figure 16:
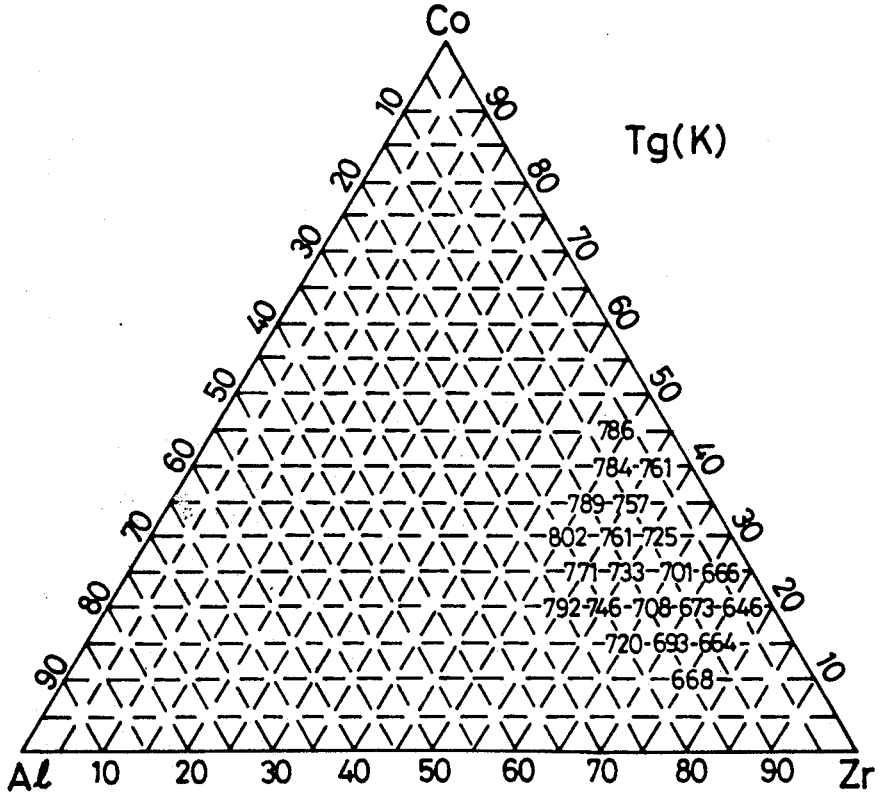
FIGS. 16, 17 and 18 are diagrams showing the measurement results of glass transition temperature, crystallization temperature and supercooled liquid temperature range for the same system alloys, respectively.
Figure 17:
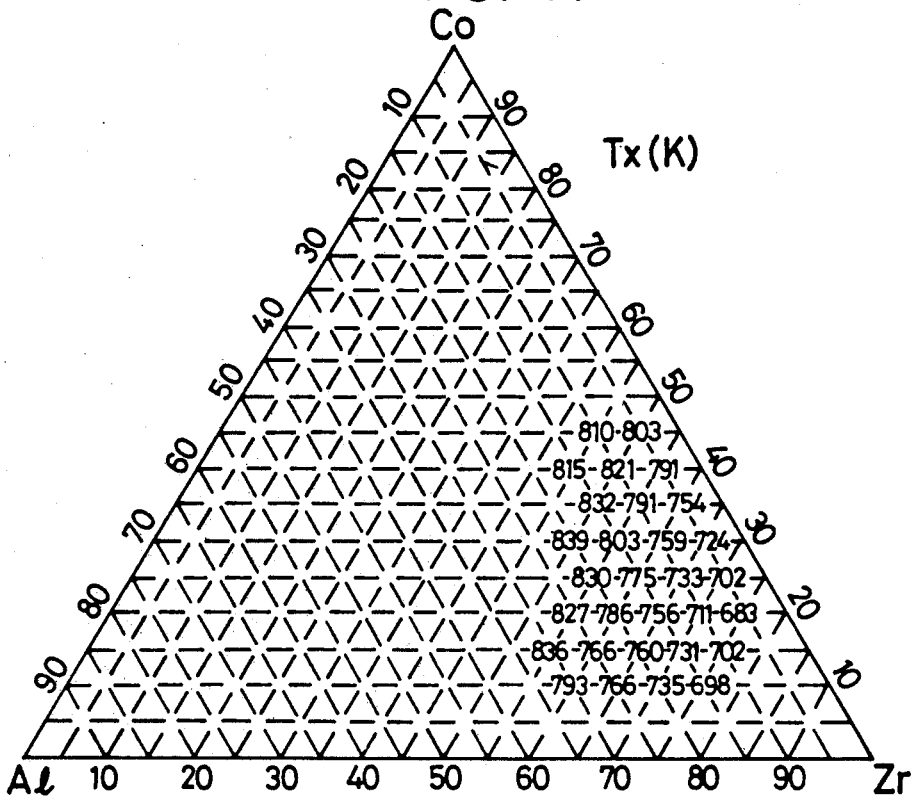
Figure 18:
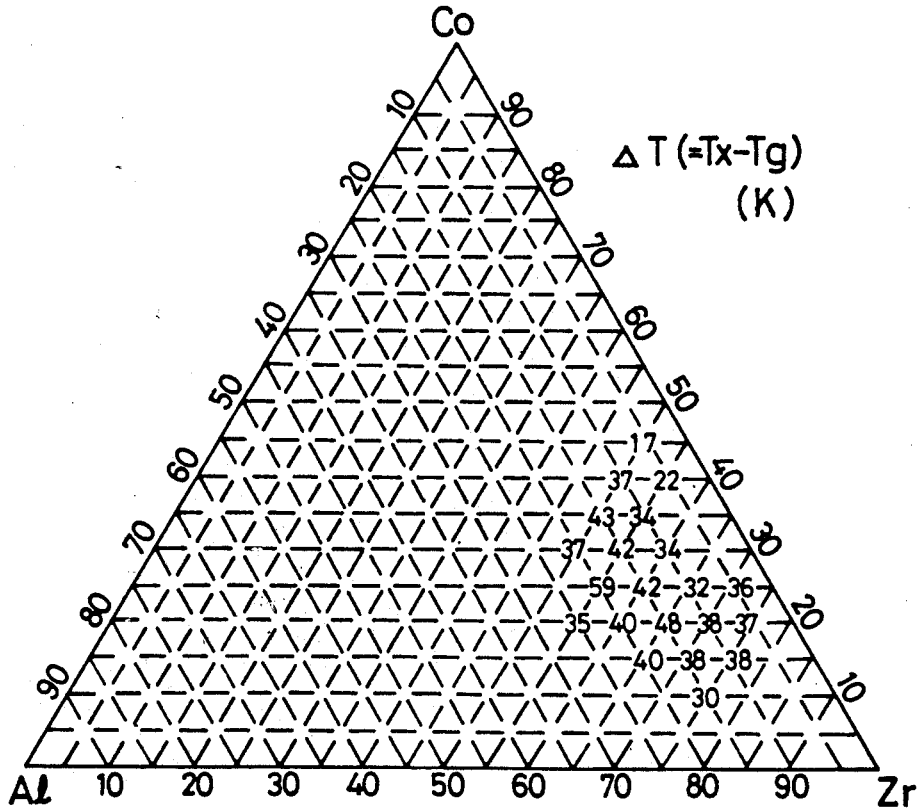
Figure 22:
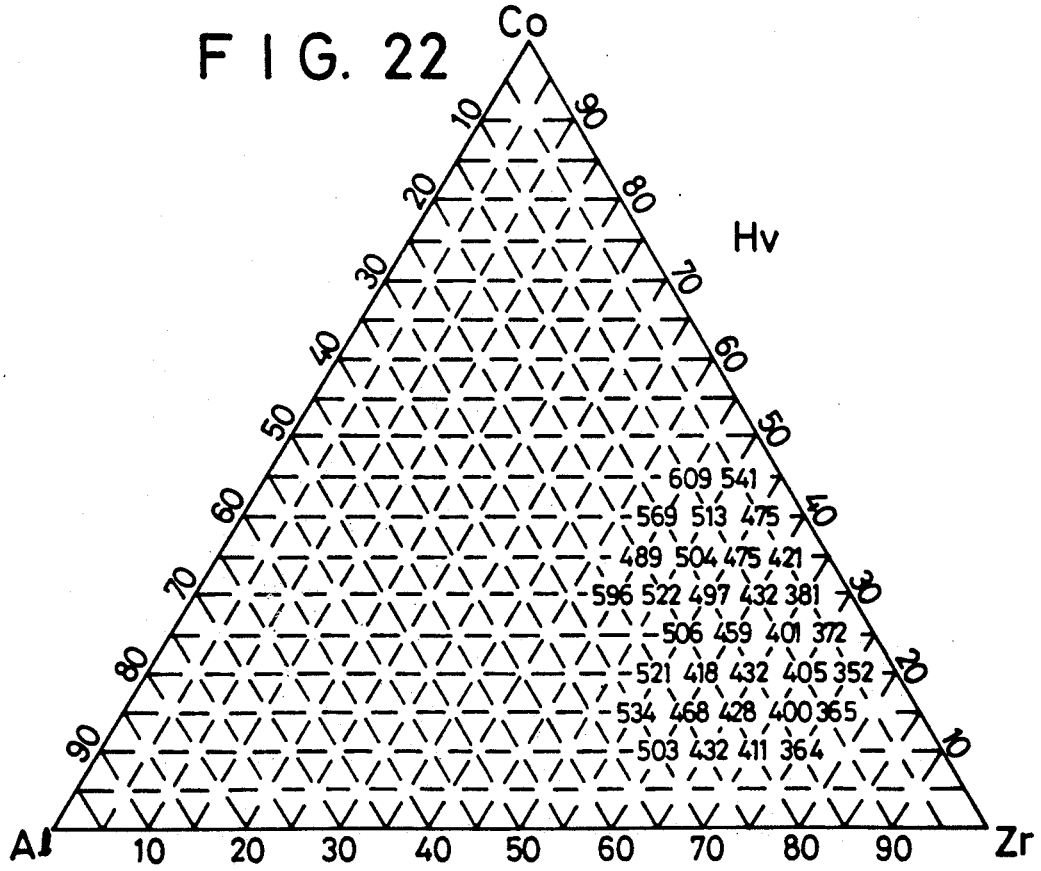
FIG. 22 is a diagram showing the measurement results of hardness for Zr-Co-Al system alloys.

The Zr-Co-Al system compositions shown in FIG. 15 were also tested in the same manner as set forth above. FIG. 22 shows the hardness distribution of ribbons falling within the amorphous-phase region in compositions as shown in FIG. 15. The hardness (Hv) of the thin ribbons ranges from 325 to 609 (DPN) and decreases with increase in the Zr content. FIG. 16 shows the change of Tg (glass transition temperature) in the amorphous-phase forming region as shown in FIG. 15 and the change greatly depends on the Zr content change. In detail, the Tg value is 802 degrees K at 50 atomic % Zr, decreases with an increase in the Zr content and is 646 degrees K at 75 atomic % Zr. FIG. 17 shows the change of Tx (crystallization temperature) in the amorphous-phase forming region shown in FIG. 15 and the Tx change strongly depends on the Zr content, as referred to FIG. 16. In detail, the Tx value is 839 degrees K at 50 atomic% Zr, decreases with an increase in the Zr content and reaches 683 degrees K at 75 atomic% Zr. FIG. 18 shows the temperature difference (Tx-Tg) between Tg and Tx in FIGS. 16 and 17, which is the supercooled liquid temperature range. As shown from the figure, a Zr content of 55 atomic % provides 59 K.

Further, Table 1 shows the results of tensile strength and rupture elongation at room temperature measured for 16 test specimens included within the amorphous compositional range of the present invention. All of the tested specimens showed high tensile strength levels of not less than 1178 MPa together with a rupture elongation of at least 1.6% which is very high value as compared with the rupture elongation of less than 1% of ordinary amorphous alloys.

TABLE 1

| | Tensile Strength $\sigma_f$ (MPa) | Rupture Elongation $\epsilon_{t.f.}$ |
|---|---|---|
| $Zr_{70}Ni_{20}Al_{10}$ | 1332 | 0.022 |
| $Zr_{60}Ni_{25}Al_{15}$ | 1715 | 0.027 |
| $Zr_{60}Ni_{20}Al_{20}$ | 1640 | 0.020 |
| $Zr_{65}Ni_{20}Al_{15}$ | 1720 | 0.028 |
| $Al_{10}Zr_{70}Fe_{20}$ | 1679 | 0.022 |
| $Al_{20}Zr_{70}Fe_{10}$ | 1395 | 0.016 |
| $Al_{10}Zr_{65}Fe_{25}$ | 1190 | 0.020 |
| $Al_5Zr_{70}Fe_{25}$ | 1811 | 0.028 |
| $Al_{15}Zr_{70}Fe_{15}$ | 1790 | 0.019 |
| $Al_{15}Zr_{65}Fe_{20}$ | 2034 | 0.024 |
| $Al_{20}Zr_{60}Co_{20}$ | 1628 | 0.019 |
| $Al_{10}Zr_{70}Co_{20}$ | 1400 | 0.017 |
| $Al_{10}Zr_{60}Co_{30}$ | 1458 | 0.019 |
| $Al_{20}Zr_{70}Co_{10}$ | 1299 | 0.017 |
| $Al_5Zr_{70}Co_{25}$ | 1631 | 0.024 |
| $Al_{15}Zr_{70}Co_{15}$ | 1178 | 0.019 |

As can be seen from the above results, the alloys of the present invention have an amorphous phase and a wide supercooled liquid region in a wide compositional range. Therefore, the alloys of the present invention are not only ductile and readily-processable materials, but also high strength and highly thermal-resistant materials.

EXAMPLE 2

A further amorphous ribbon was prepared from an alloy having the composition $Zr_{60}Ni_{25}Al_{15}$ in the same way as described in Example 1 and was comminuted into a powder having a mean particle size of about 20 μm using a rotary mill, which is a known comminution device. The communicated powder was loaded into a metal mold and compression-molded under a pressure of 20 kg/mm$^2$ at 750 degrees K for a period of 20 minutes in an argon gas atmosphere to give a consolidated material of 10 mm in diameter and 8 mm in height. There was obtained a high strength consolidated bulk material having a density of at least 99% relative to the theoretical density and no pores or voids were detected under an optical microscope. The consolidated material was subjected to X-ray diffraction. It was confirmed that an amorphous phase was retained in the consolidated bulk materials.

EXAMPLE 3

An amorphous alloy powder of $Zr_{60}Ni_{25}Al_{15}$ obtained in the same way as set forth in Example 2 was added in an amount of 5% by weight to alumina powder having a median particle size of 3μm and was hot pressued under the same conditions as in Example 2 to obtain a composite bulk material. The bulk material was investigated by an X-ray microanalyzer and it was found that it had a uniform structure in which the alumina powder was surrounded with an alloy thin layer (1to 2 μm) having a strong adhesion thereto.

EXAMPLE 4

An amorphous ribbon of a $Zr_{60}Ni_{25}Al_{15}$ alloy prepared in the same manner as described in Example 1 was inserted between iron and ceramic and hot-pressed under the same conditions as set forth in Example 2 to braze the iron and ceramic. The thus-obtained sample was examined for adhesion between the iron and the ceramic by pulling the junction portion of them. As a result, there was no rupture at the junction portion. Rupture occurred in the ceramic material part.

As can be seen from the above results, the alloys of the present invention is also useful as a brazing material for metal-to-metal bonding, metal-to-ceramic bonding or metal-to-ceramic bonding.

When Mn was used as the "M" element or Hf was used in place of Zr, the same results as described above were obtained.

What is claimed is:

1. An amorphous alloy having superior processability which has a composition represented by the general formula $$X_aM_{bl\ Alc}$$

wherein:

X is at least one element of Zr and Hf;

M is at least one element selected from the group consisting of Ni, Cu, Fe, Co and Mn; and a, b and c are, in atomic percentages:

$25 \leqq a \leqq 85$, $5 \leqq b \leqq 70$ and $5 < c \leqq 35$, said alloy being at least 50% (by volume) composed of an amorphous phase.

2. An amorphous alloy as claimed in claim 1 in which said a, b and c in said general formula are, in atomic percentages:

$35 \leqq a \leqq 75$, $15 \leqq b \leqq 55$ and $5 \leqq c \leqq 20$.

3. An amorphous alloy as claimed in claim 1 in which said a, b and c in said general formula rea, in atomic percentages:

$55 \leqq a \leqq 70$, $15 \leqq b \leqq 35$ and $5 \leqq c \leqq 20$.

* * * * *

UNITED STATES PATENT AND TRADEMARK OFFICE

CERTIFICATE OF CORRECTION

PATENT NO. : 5 032 196

DATED : July 16, 1991

INVENTOR(S) : Tsuyoshi MASUMOTO et al

It is certified that error appears in the above-identified patent and that said Letters Patent is hereby corrected as shown below: On the title page:

Item [57], line 5; after "wherein" insert a colon (:).

Column 8, line 49; after "formula" insert a colon (:).

line 65; change "rea" to ---are---.

Signed and Sealed this

Ninth Day of March, 1993

*Attest:*

STEPHEN G. KUNIN

*Attesting Officer*

*Acting Commissioner of Patents and Trademarks*